US011759810B2

(12) United States Patent
Moretti

(10) Patent No.: US 11,759,810 B2
(45) Date of Patent: Sep. 19, 2023

(54) FLUID SUBSTANCES REFILL DEVICE

(71) Applicant: LUMSON S.P.A., Capergnanica (IT)

(72) Inventor: Matteo Moretti, Crema (IT)

(73) Assignee: LUMSON S.P.A., Capergnanica (IT)

( * ) Notice: Subject to any disclaimer, the term of this patent is extended or adjusted under 35 U.S.C. 154(b) by 0 days.

(21) Appl. No.: 17/860,591

(22) Filed: Jul. 8, 2022

(65) Prior Publication Data

US 2023/0011490 A1 Jan. 12, 2023

(30) Foreign Application Priority Data

Jul. 9, 2021 (IT) ..... 102021000018116

(51) Int. Cl.
*B05B 11/00* (2023.01)

(52) U.S. Cl.
CPC ..... *B05B 11/0097* (2013.01); *B05B 11/0038* (2018.08)

(58) Field of Classification Search
CPC ..... B05B 11/0097; B05B 11/0038; B05B 11/1047
See application file for complete search history.

(56) References Cited

U.S. PATENT DOCUMENTS 10,717,098 B2 * 7/2020 Delmon ..... B05B 11/026
10,864,539 B2 * 12/2020 Delmon ..... B05B 11/028
2002/0111363 A1 * 8/2002 Drechsel ..... A61K 9/0078 514/291
2004/0112921 A1 6/2004 Nomoto
2011/0024452 A1 * 2/2011 Moretti ..... B05B 11/0054 222/105
2022/0152639 A1 * 5/2022 Moretti ..... B65D 41/005
2022/0161987 A1 * 5/2022 Moretti ..... B05B 11/1059

FOREIGN PATENT DOCUMENTS

| | | |
|---|---|---|
| EP | 2243557 B1 | 4/2015 |
| EP | 3037174 A1 | 6/2016 |
| JP | 05031790 A | 7/1991 |
| JP | 05031791 A | 7/1991 |
| WO | 2020115399 A1 | 6/2020 |

* cited by examiner

*Primary Examiner* — Paul R Durand
*Assistant Examiner* — Randall A Gruby
(74) *Attorney, Agent, or Firm* — Dickinson Wright PLLC; Andrew D. Dorisio

(57) ABSTRACT

A refill device for a container having an opening to a cavity including a first connection element with first connection means for removably connecting the refill device to the opening, a bag first part filled with a substance for housing in the container, a neck and a connection part between the neck and the first part, and a flange, a pump, a ring nut element connected to the first connection element to connect the pump and bag thereto, the first connection element including a body with an upper part including an upper opening delimited by a wall for resting a portion of the flange and connection means, a lower part including an opening and first means for removably connecting the refill device, the first connection element including second connection means for removably connecting a protection element to the first connection element before associating the refill device with the container.

11 Claims, 15 Drawing Sheets

FLUID SUBSTANCES REFILL DEVICE

Figure 1:
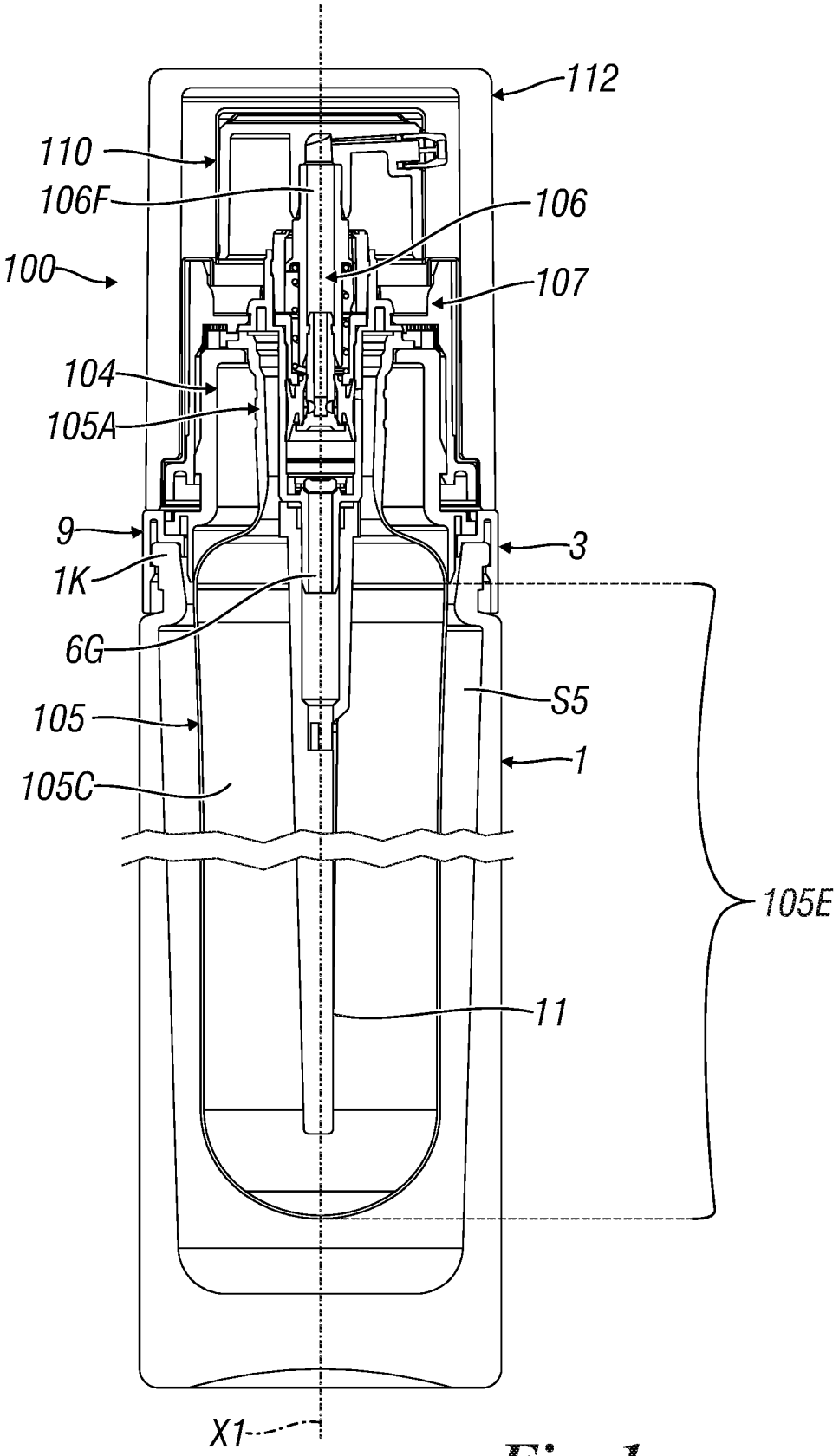

This patent application claims the benefit of Italian Patent Application for Invention No. 102021000018116 filed on Jul. 9, 2021, the disclosure of which is incorporated herein by reference.

TECHNICAL FIELD

The present invention relates to a refill device for fluid substances.

BACKGROUND

It is known to enclose fluid substances, both liquid and creamy, in containers from which such substances are dispensed by manually actuating a pump mounted on the mouth of a respective container. The actuation of the pump causes the drawing of a predefined amount of fluid substance from the container, in which, if the container is rigid, there would be formed a vacuum which would prevent further drawing and dispensing of the substance, if there were not provided for the entry of air into the container (something which, generally, occurs at the areas of contact and sliding of the pump on the body of the pump), or should the container not comprise a bottom sealingly movable along the inner cylindrical surface of the container.

The latter system for compensating the volume of the containers for reducing the internal volume thereof and maintaining the internal pressure constant is however quite strenuous and expensive.

An alternative system provides for introducing the fluid to be dispensed in a bag made of deformable and flexible material, in turn containing a neck to which the dispensing pump is connected. The bag is introduced into an outer and hermetically sealed container by a pump after the filling.

Furthermore, the systems that use a bag are usually used for systems of the "airless" type.

Such a device is shown, for example, in the Japanese patent applications JP 05 031790 and JP 05 031791. In these documents, the bag has a neck from which there transversely protrudes a flange, which—in use—rests against the vacant edge of the neck of the outer container.

Document US 2004/0112921 also discloses the association of the pump with the neck of the bag through a ring nut element which is screwed to the neck of the outer container. In this manner, the pump is kept sealingly pressed by the ring nut on the flange protruding from the neck of the bag, while there are provided for passages for the flow of air from the external to the space between the outer surface of the bag and the inner surface of the container so as to allow the bag to shrink as the amount of fluid substance dispensed by the pump increases.

In these devices, at the end of the dispensing of the fluid substance, the ring nut which retains the pump is unscrewed from the neck of the container and removed, while the bag remains inside the container. This represents a problem for the correct disposal of the device, given that should the bag be contained in a glass container, these two elements should be disposed of separately. Furthermore, it is difficult to manually remove the bag from the outer container.

A solution to this problem is illustrated in patents EP 2 243 557 and EP3 037 174 in which the dispensing device provides for means for connecting the bag and the pump to one or more connection elements in turn connected to the neck of a rigid container suitable to contain the bag, which allow to remove these connection elements from the neck of the container and simultaneously also remove the bag from the outer container, once the substance contained in the bag has been fully dispensed. In these devices for filling the bag of the substance to be dispensed, when it is empty it should be associated with the connection elements, then inserted into the rigid container and then filled with the substance to be dispensed. The bag may be filled only when the bag has been inserted into the rigid container.

US2011/024452 teaches a device for dispensing fluid substances comprising an outer container suitable for housing a refill comprising a deformable bag, containing the fluid substances to be dispensed, in turn housed in a protection element. An upper portion of the protection element comprises: a step part suitable for resting on an upper free edge of the outer container and forming a support surface for an upper flange of the deformable bag, and portions for blocking a connecting element of the refill, which in turn, when it is blocked by said terminal portion, is able to block said flange of the bag against said step part of the upper portion of the protection element, to connect a pump to the refill, and to connect the refill to the outer container.

SUMMARY

An object of the present invention is to provide a refill device suitable to be used combined with the containment and dispensing devices of the known type which allows to fill the bag with a predefined amount of fluid substance to be dispensed in an alternative way to what is described in the prior art, and also when the bag is not inserted into the relative container, which however also allows to remove the bag from the container once said substance contained in the bag has been dispensed.

Another object of the invention is to provide a refill device that is easy to manufacture as well as reliable and safe to use.

A further object is to provide a refill device that is more sustainable from an environmental and ecological point of view and which allows a partial re-use of at least some of the components thereof.

These and other objects are achieved by providing a refill device according to the technical teachings of the attached claims.

BRIEF DESCRIPTION OF THE DRAWING FIGURES

Figure 2A:
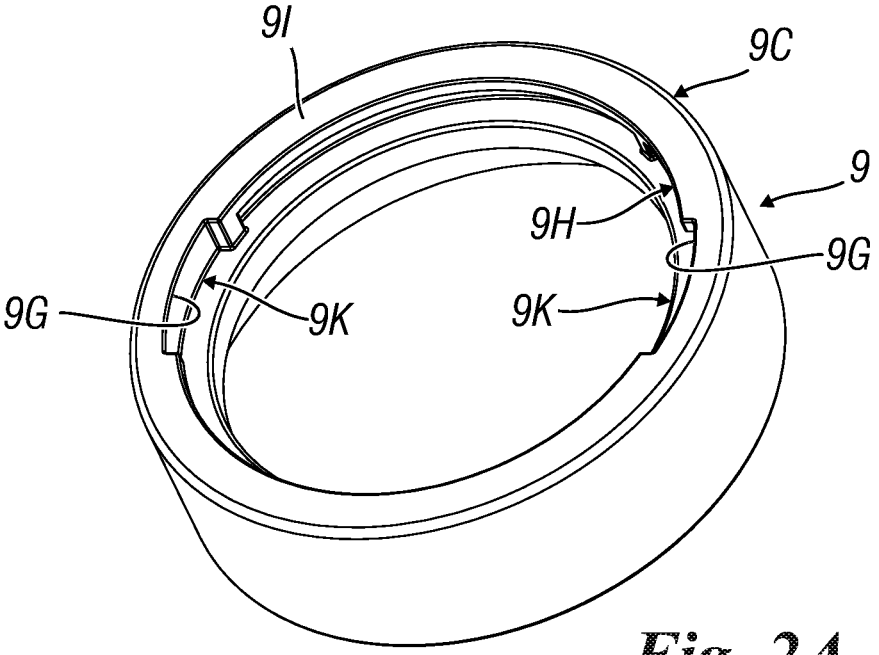
Figure 2B:
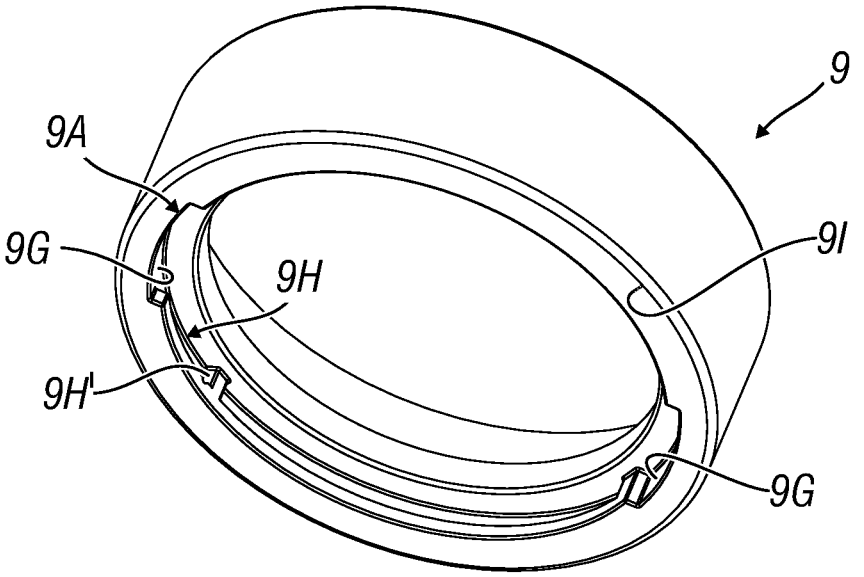
Figure 3A:
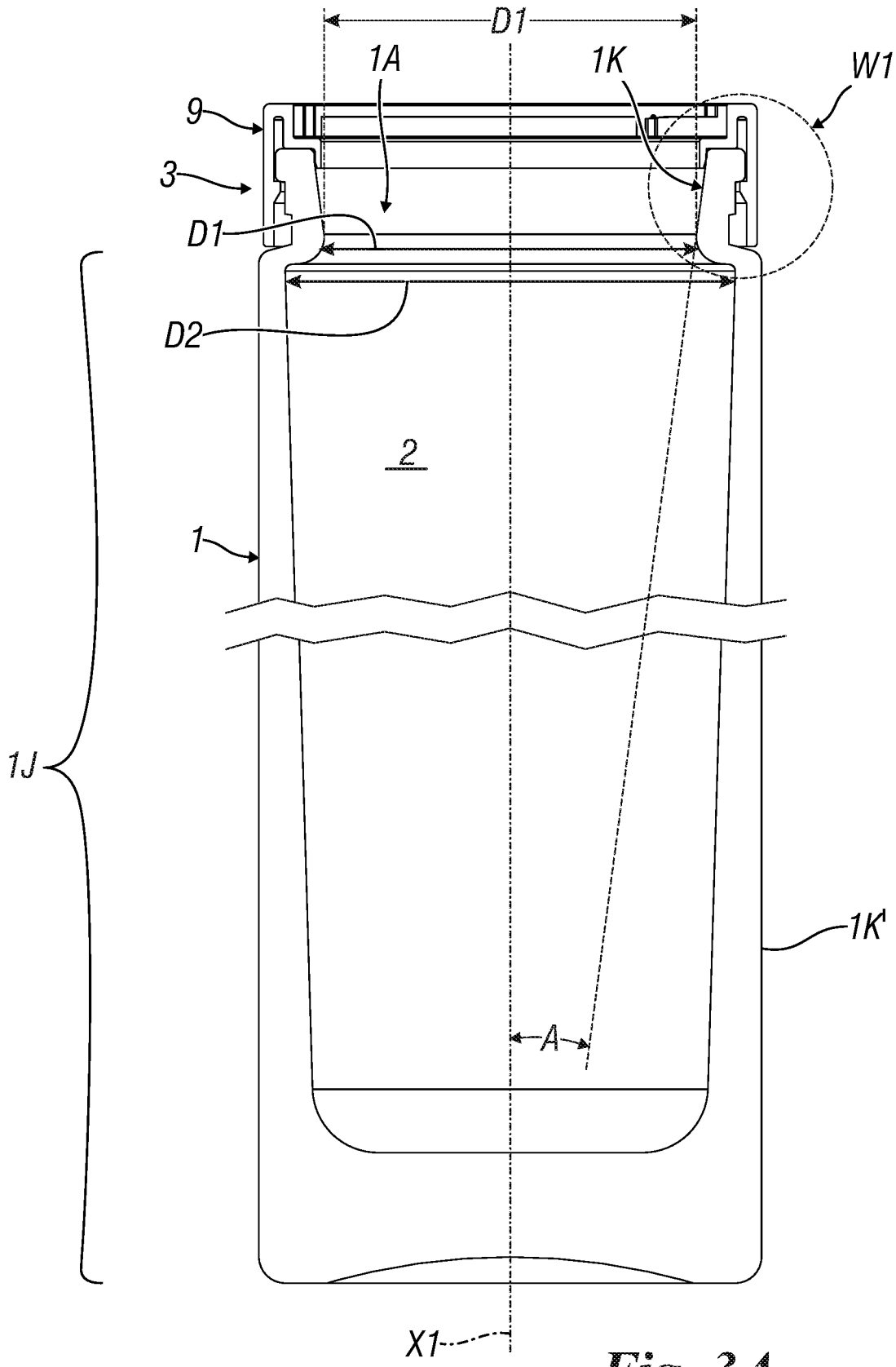
Figure 3B:
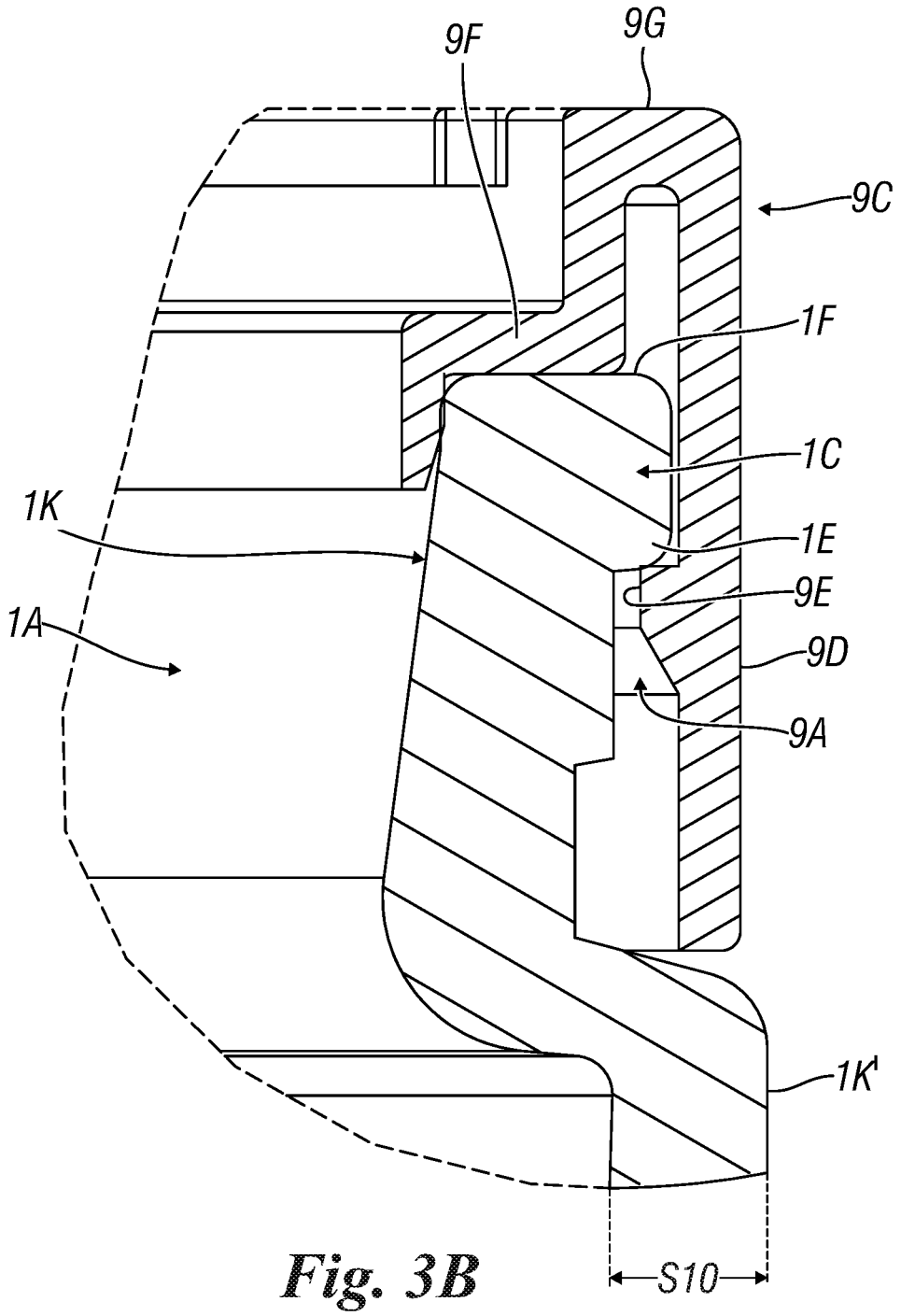
Figure 4A:
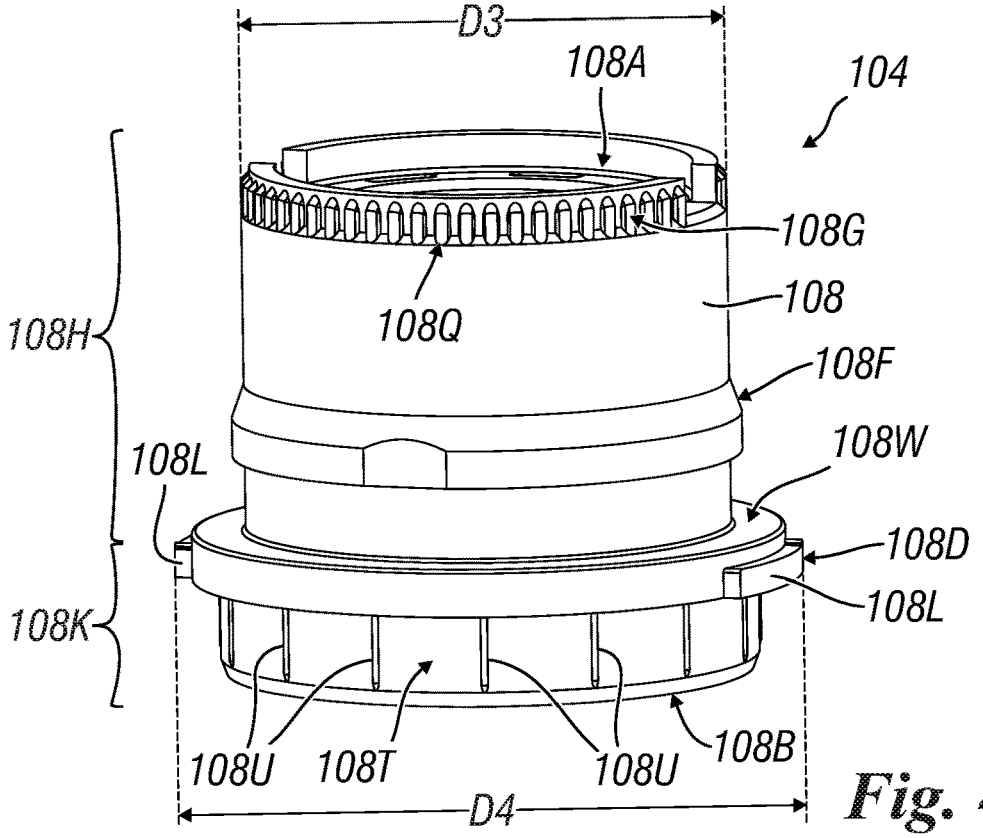
Figure 4B:
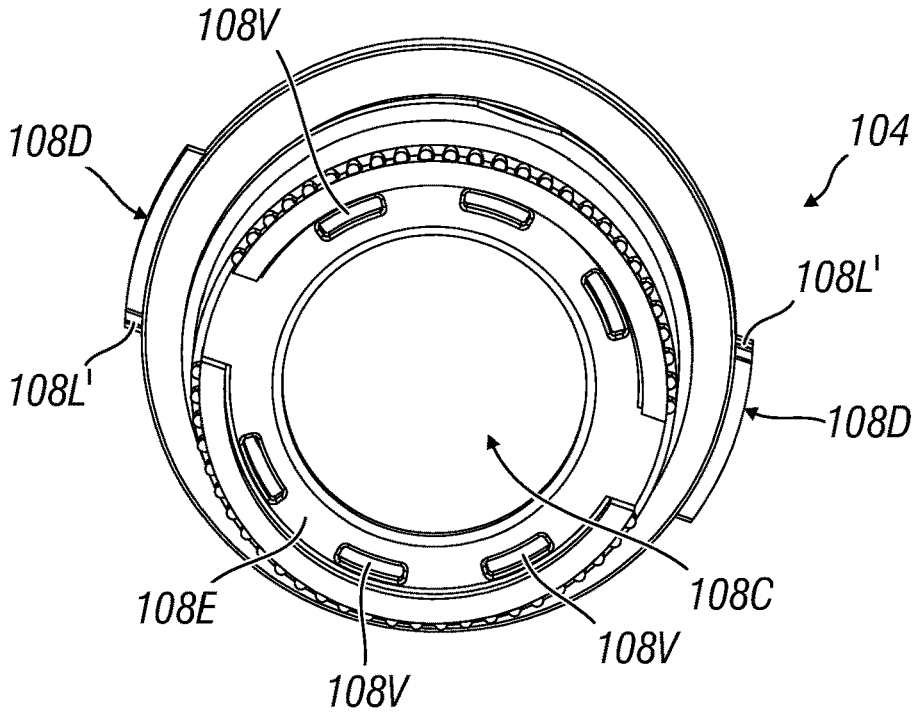
Figure 4C:
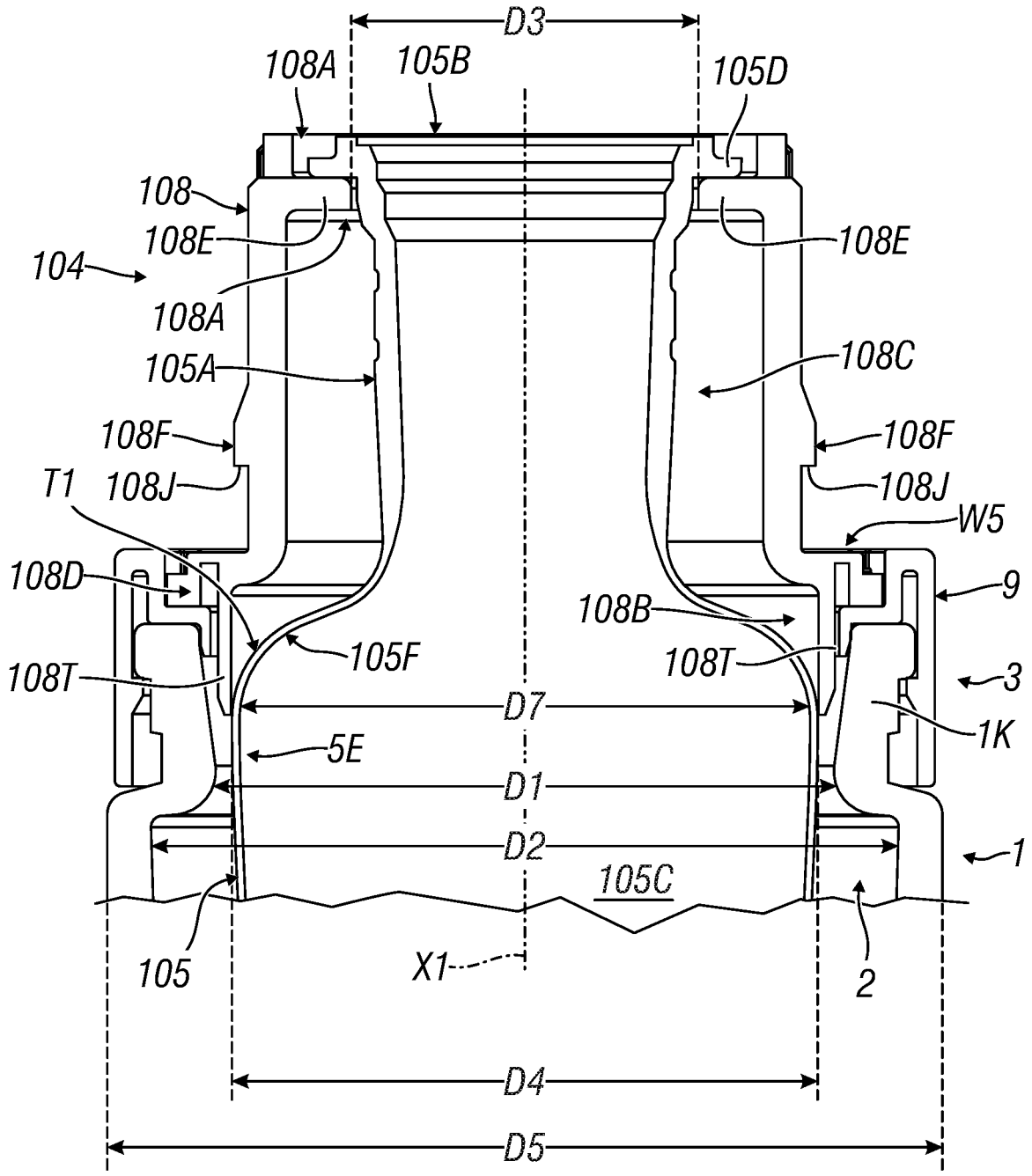
Figure 4D:
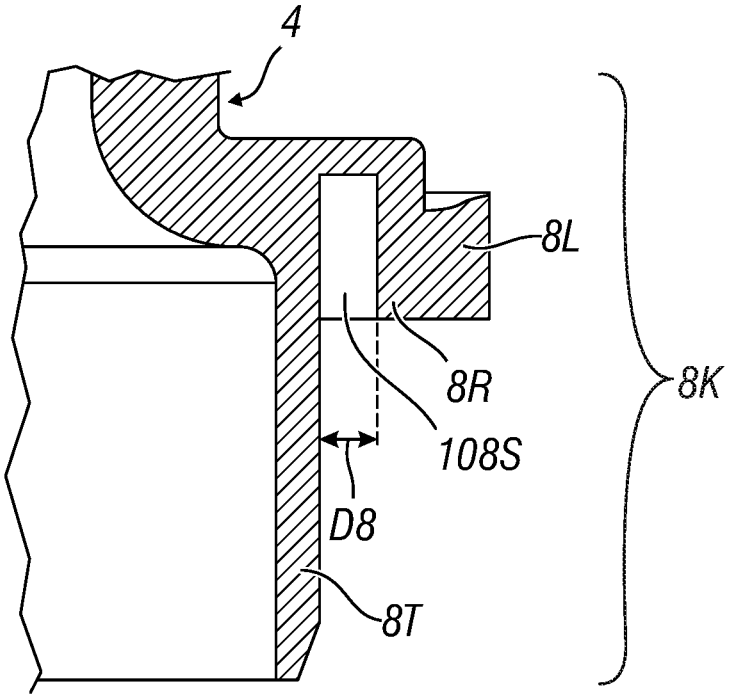
Figure 4E:
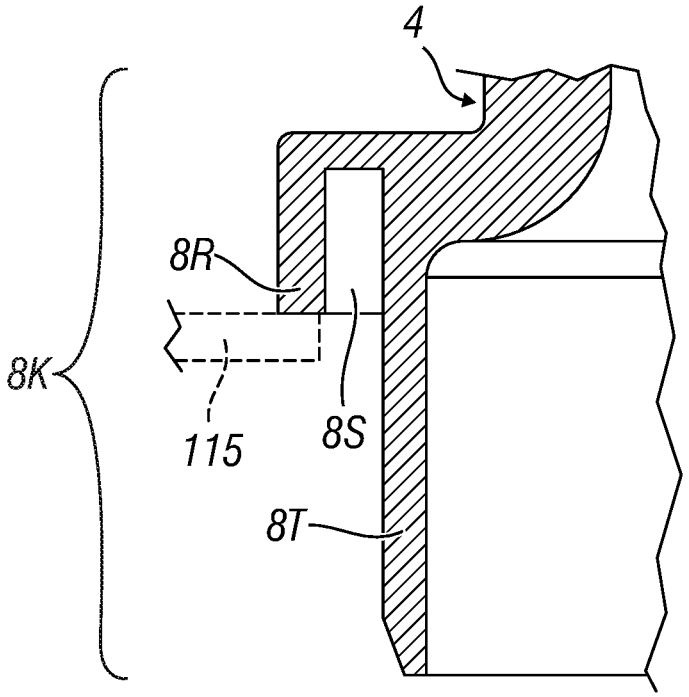
Figure 5:
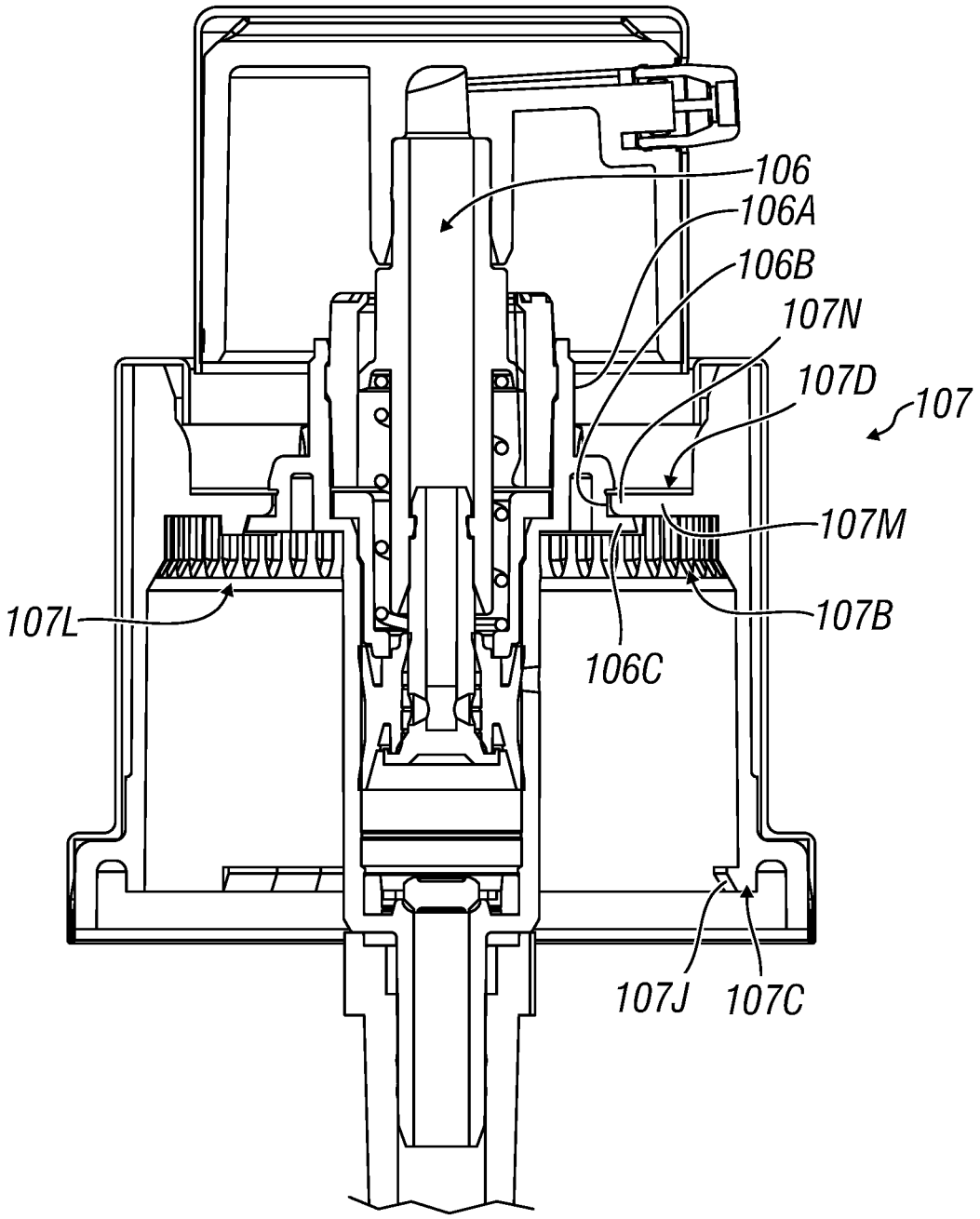
Figure 6A:
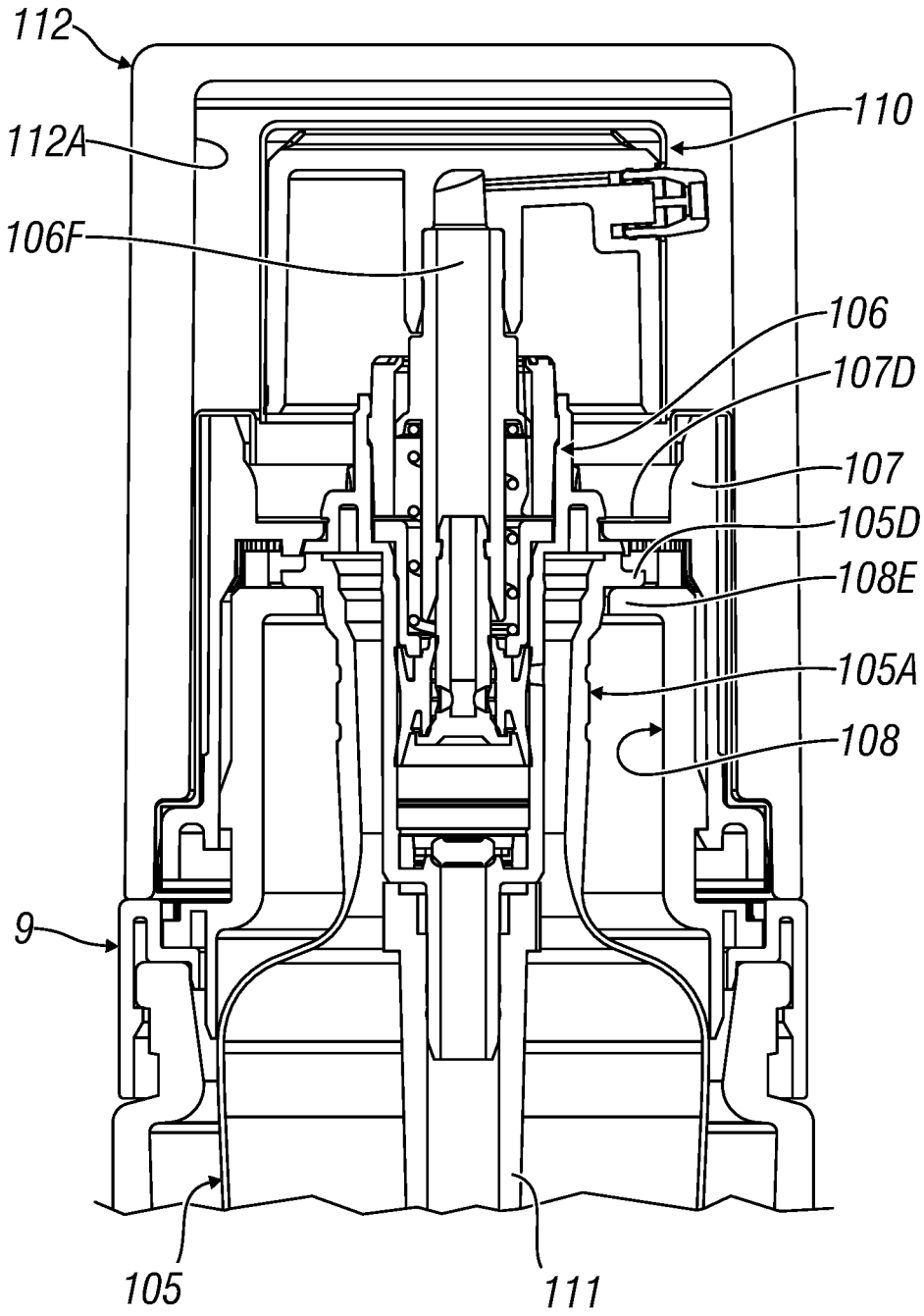
Figure 6B:
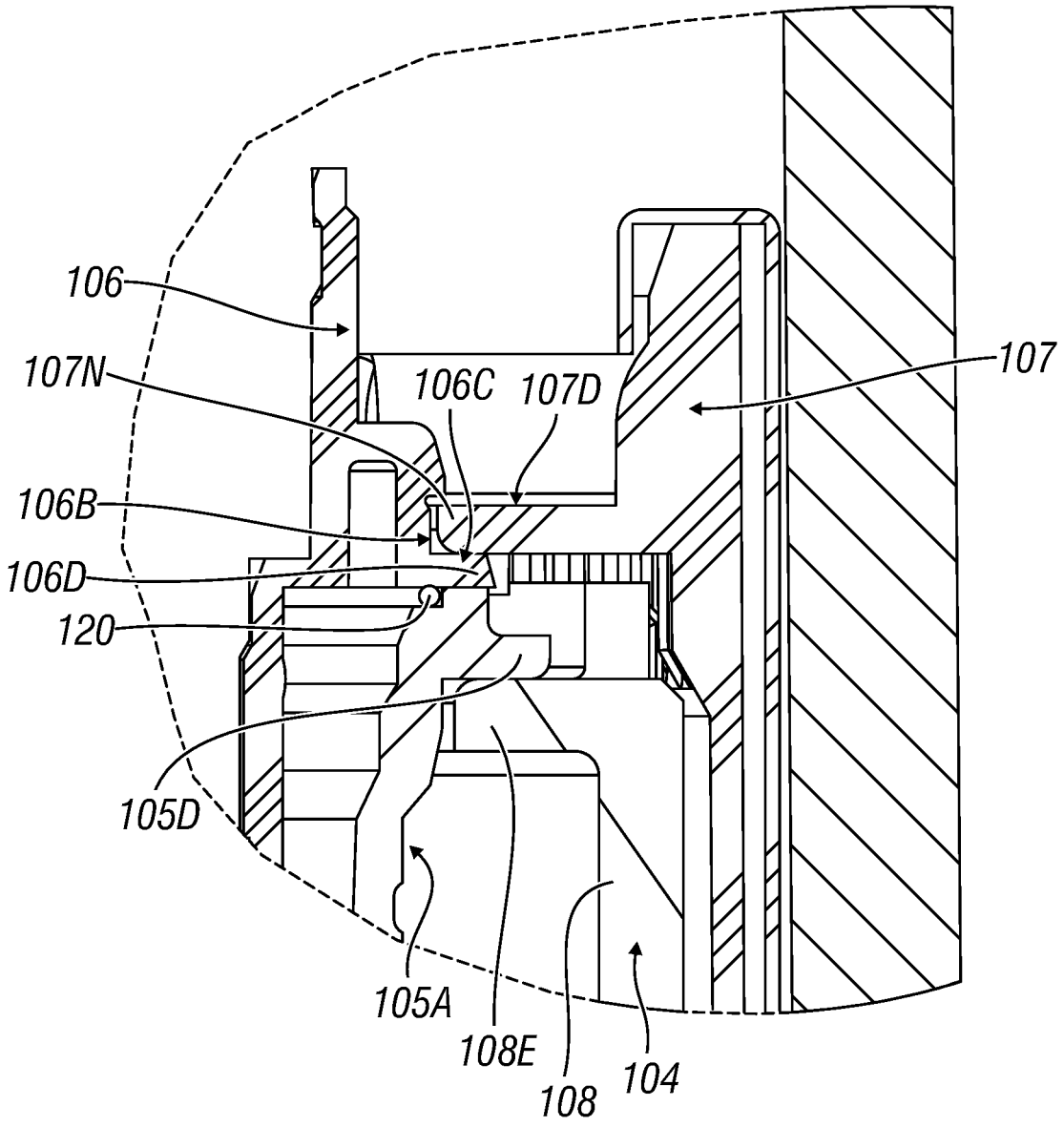
Figure 7:
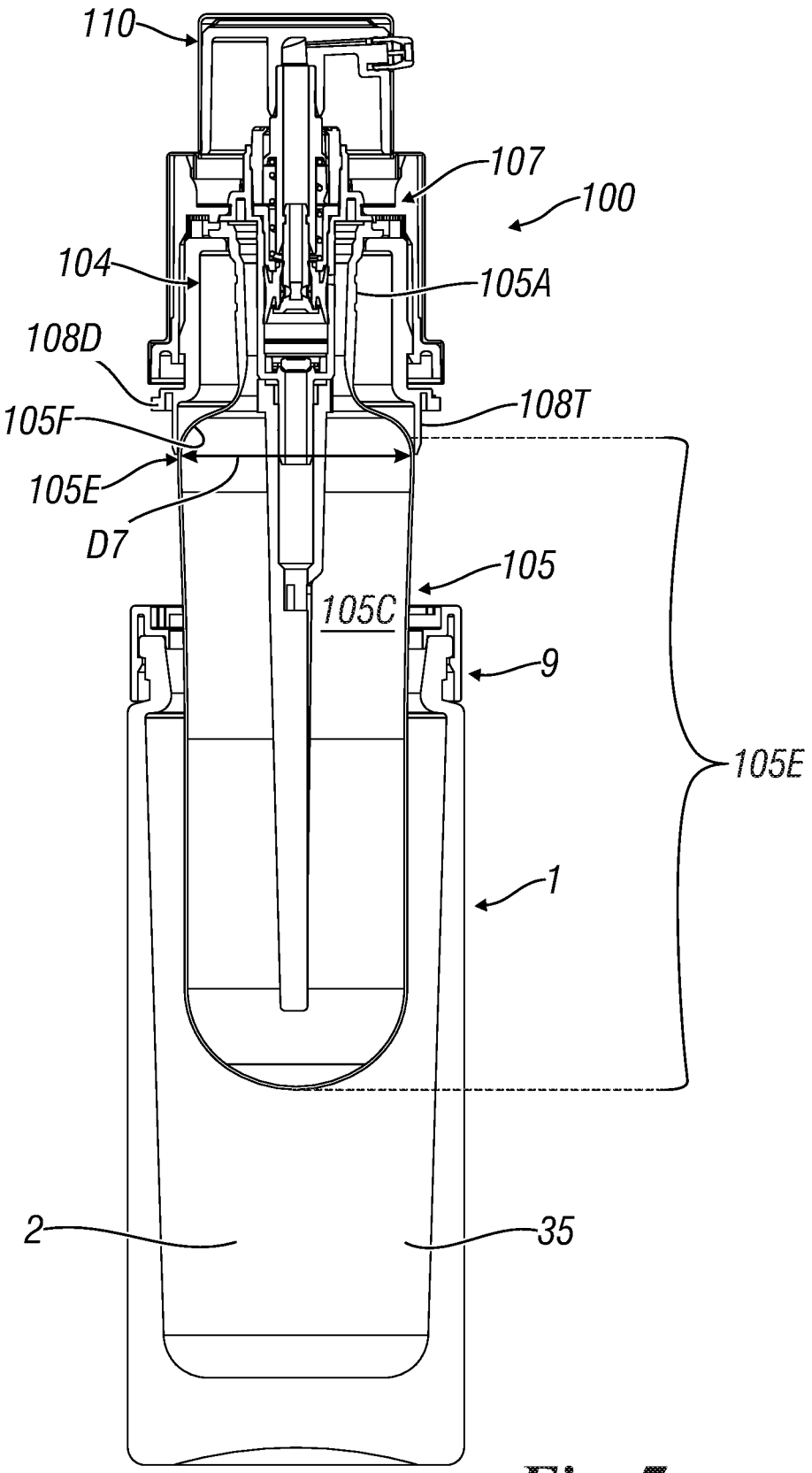
Figure 8:
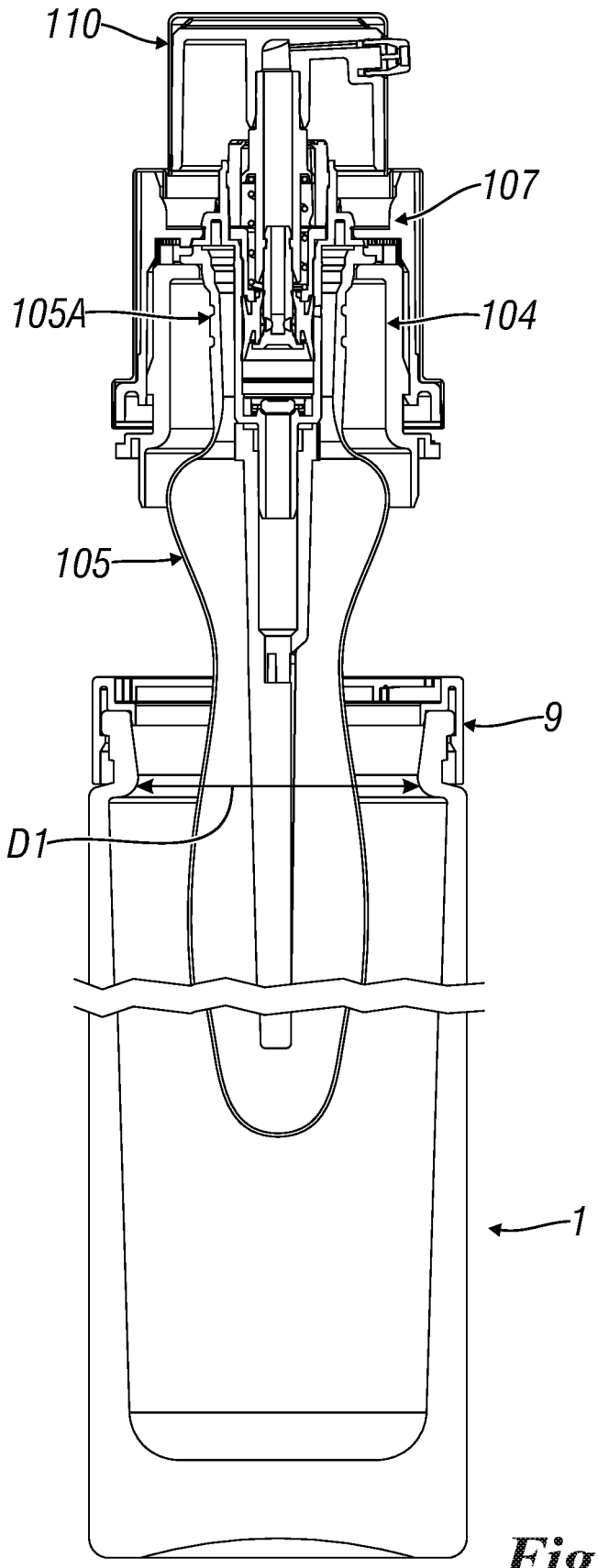
Figure 9A:
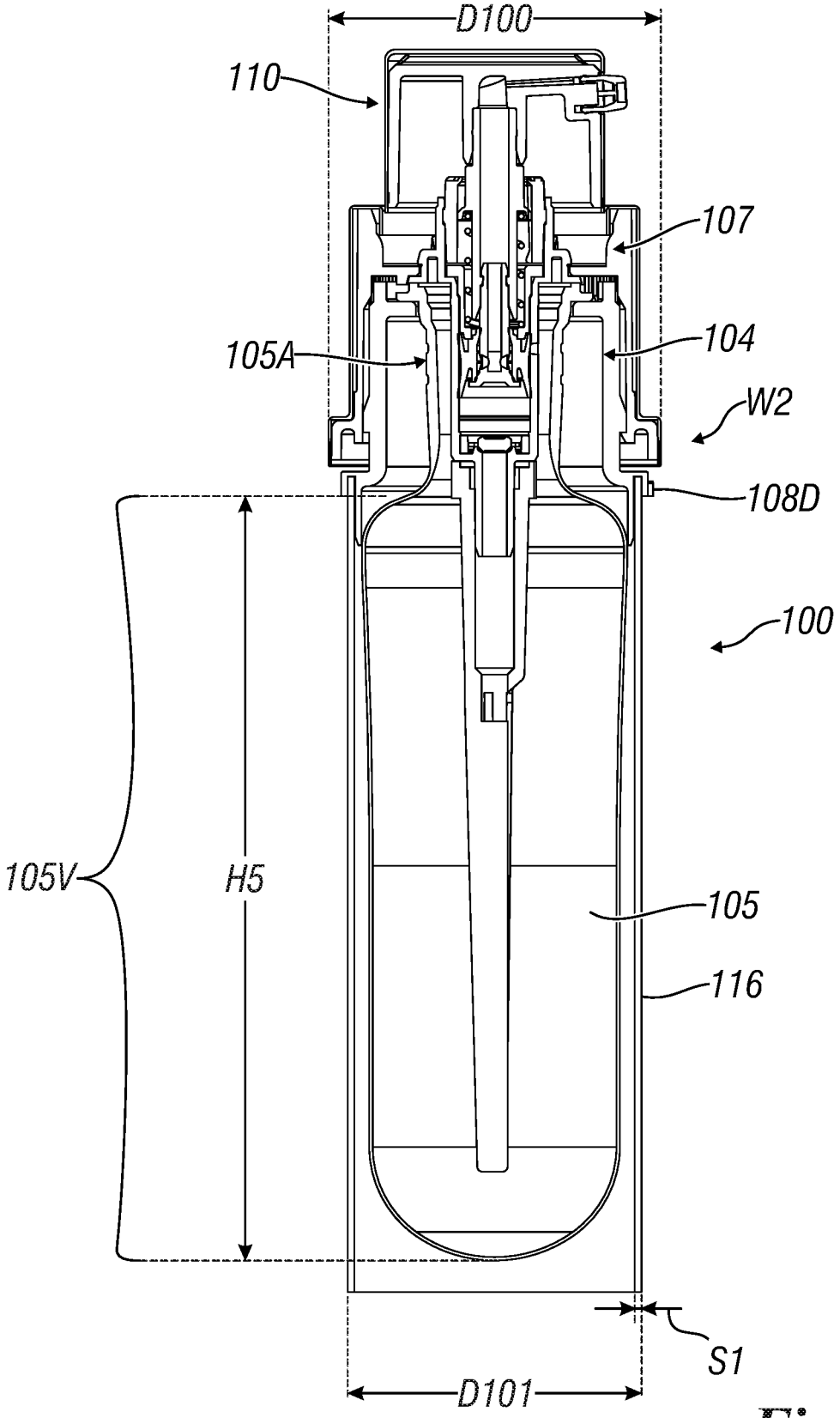
Figure 9B:
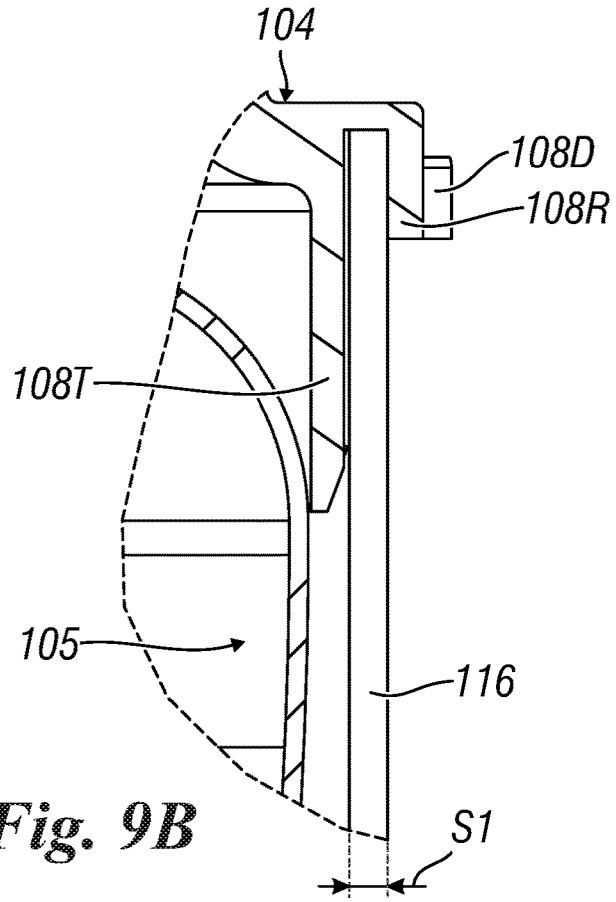
Figure 9C:
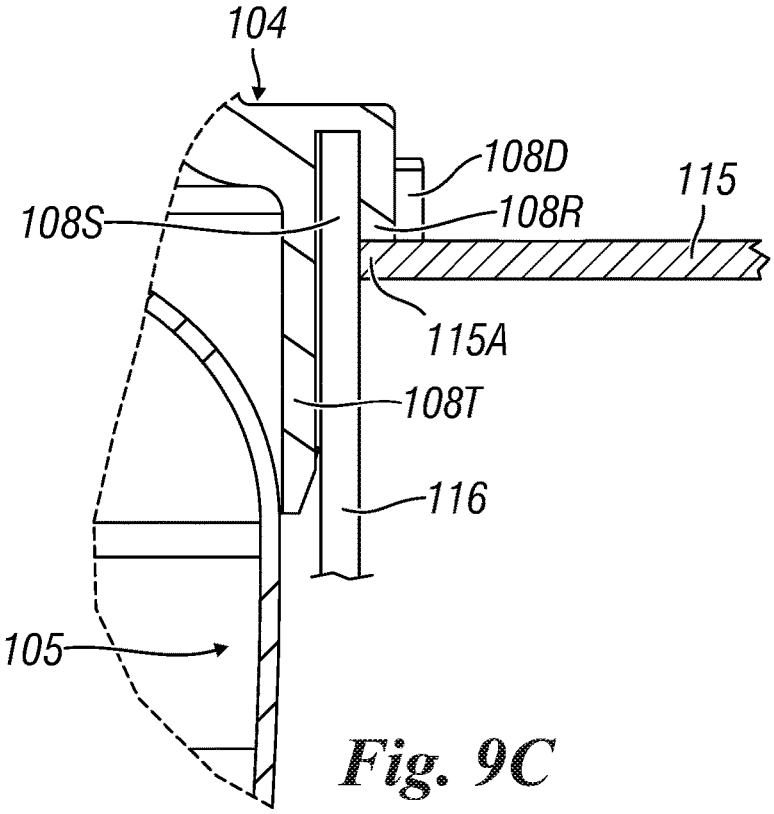
Figure 10A:
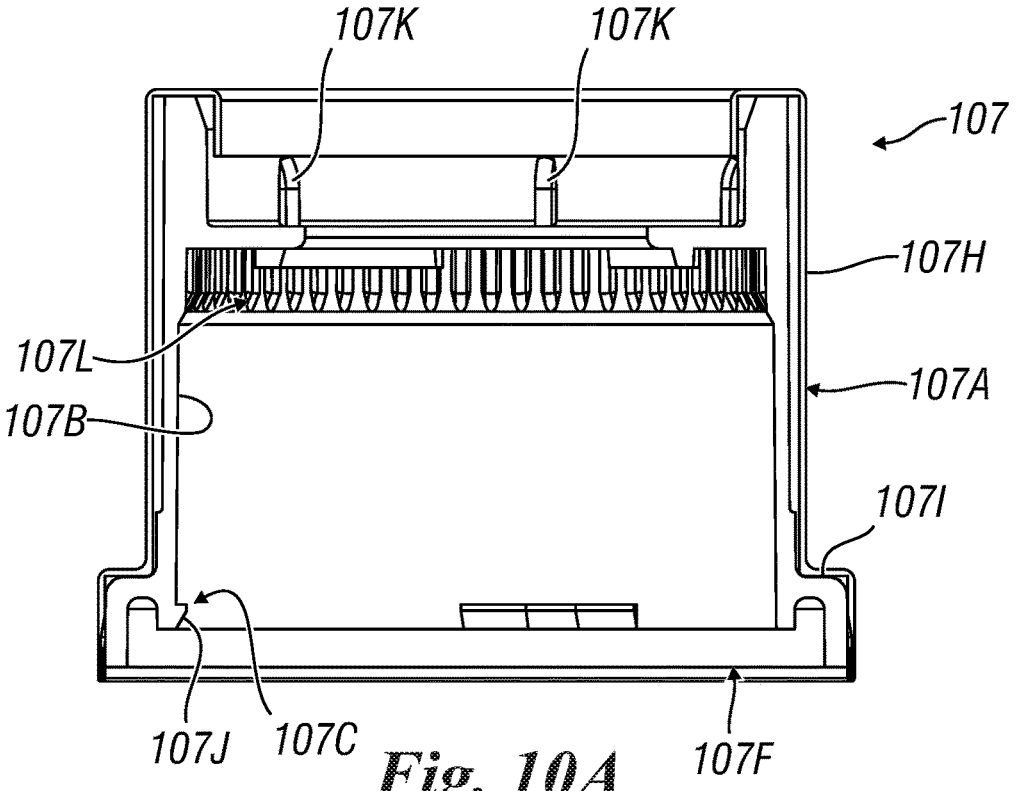
Figure 10B:
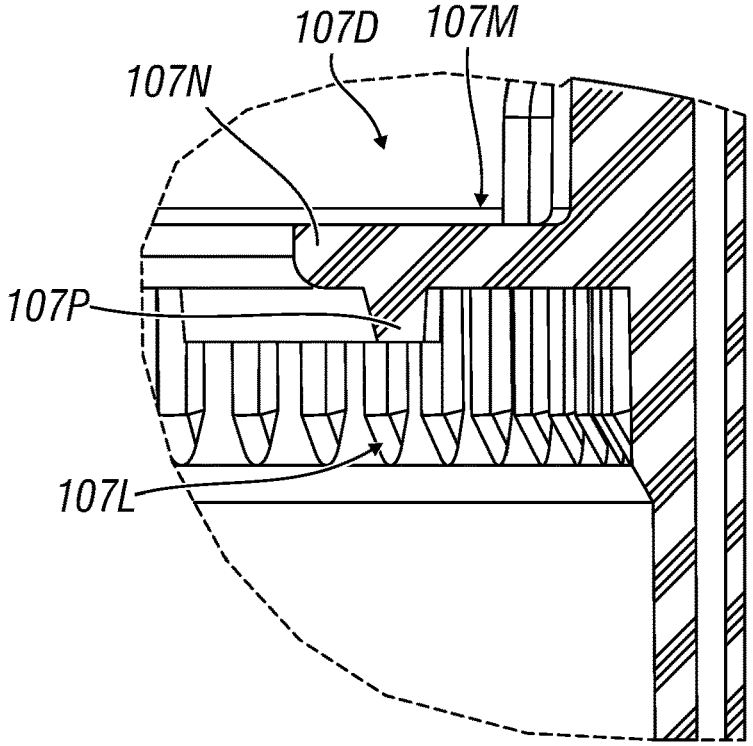

Further characteristics and advantages of the invention will be apparent from the description of a preferred but not exclusively embodiment of a device for containing and dispensing fluid substances, illustrated by way or non-limiting example in the attached drawings, wherein:

FIG. 1 shows a sectional schematic view of a refill device according to the invention when it is associated with a container, FIGS. 2A, 2B show schematic perspective views taken from two different angles of a first component of the container of FIG. 1, FIGS. 3A and 3B respectively show a sectional schematic view of the container and an enlarged schematic view of the detail indicated by the arrow W1 of FIG. 3A, FIGS. 4A, 4B show schematic perspective views taken from two different angles of a first component of the refill device, FIG. 4C shows a sectional schematic view of some components of the refill device when they are associated with a container (the latter shown only partially);

FIGS. 4D and 4E show sectional schematic views, taken in two different positions, of a lower part of the first component of FIG. 4A, FIG. 5 shows a sectional schematic view of a second component of the refill device associated with a common pump for dispensing fluid substances, FIGS. 6A, 6B show two sectional schematic views, in different scales, of some components of the device when they are associated with each other and with a container (the latter only shown partially);

FIG. 7 shows a sectional schematic view of the refill device when it is associated with a container, FIG. 8 shows a sectional schematic view of the refill device when it is removed from a container, FIGS. 9A, 9B, 9C show sectional schematic views of the refill device and an enlarged view of the detail indicated by the arrow W2 of FIG. 9A, and a second view of the detail of FIG. 2 when a protection element is also associated therewith, FIGS. 10A, 10B show sectional schematic views of a further component of the refill device of FIG. 1.

DETAILED DESCRIPTION

With reference to the figures mentioned above, they show a fluid substances refill device 100, for a container 1 having an opening 1A (FIG. 3A) for access to a cavity 2 of the container, said refill device comprising:

a first connection element 104 comprising:

first connection means 108D (FIG. 4A) for connecting said refill device to said container removably and at said opening 1A, a bag 105 made of deformable material, filled with a predefined amount of said fluid substances, and comprising:

at least one first part 105E, filled with said substance to be dispensed and suitable to be housed inside said cavity 2 of the container and in turn delimiting a cavity 105C suitable to contain said fluid substances, a neck 105A which departs from an end of said first part 105E of the container, and which has an opening 105B for access to said cavity 105C of said first part 105E of the bag, a connection part 105F (FIG. 4C) between said neck and said first part 105E, and a flange 105D which extends transversely to said neck of the bag at said opening 105B of the neck;

a pump 106 which can be actuated manually to draw the fluid substance from the bag 105 and supply it to the external, wherein the pump 106 is at least partially housed in the neck 105A of the bag 105;

a ring nut element 107 connected, for example snap-coupled, to said first connection element 104, and suitable to connect said pump 106 and said bag 105 to said first connection element 104;

wherein the first connection element 104 comprises:

a body 108 (FIG. 4 A) having an upper part 108H and a lower part 108K which delimit a tubular through seat 108C suitable to at least partially, and preferably fully, house the neck 105A of the bag 105 and at least partially the pump 106, when it is inserted into the neck;

wherein said upper part 108H comprises: an upper opening 108A delimited by a wall 108E for resting (FIG. 4C) at least one portion of said flange 105D of the neck 105A of the bag 105 and connection means 108F 108G (FIG. 4A) suitable to cooperate with counter connection means 107B, 107C (FIG. 10A) provided for in the ring nut element 107 for stably constraining said first connection element 104 and said ring nut element 107 to each other, so that said ring nut element 107): when it is connected to the first connection element 104 and to the pump 106, it constrains also said first connection element 104 and said at least one portion of said flange 105D to each other; and so that when said first connection element 104 is released from the container 1, the bag remains stably associated with the refill device and with the assembly formed by the first connection element 104, by the ring nut element 107, and by the pump 106;

that the lower part 108K of the first connection element 104, comprises a lower opening 108B and said first means 108D for connecting—removably and at said opening 1A—said refill device to said container, said connection means 108D being suitable to cooperate with counter connection means 3 (FIG. 1) provided for at the access opening 1A of the container 1 to removably connect said body 108 of the first connection element 104 to said container;

and that said lower part 108K of the first connection element 104, comprises second connection means 108S FIG. 4D for removably connecting a protection element 116 (FIG. 9A, 9B), suitable to protect the bag 105 containing the fluid substance to said first connection element 104 before said refill device is associated with the container.

It should be observed that in the context of the present invention, the expression a flange which extends transversely is used to indicate a flange which extends in a direction not parallel to a longitudinal axis X1 (FIG. 1).

Preferably, the openings 108A and 108B of the two upper and lower parts 108H and 108K have maximum transversal dimensions D3 and D4 different from each other with the upper opening 108A having smaller transversal dimensions D3 with respect to those D4 of the lower opening 108B.

Preferably, the transversal dimensions D1 (FIG. 3A) of the opening 1A of the container are greater than or equal to the maximum transversal dimensions D7 (FIG. 4C) of the bag 105 so as to allow to insert at least the first part 105E of the bag 105 containing the substance into said container 1, and to allow to connect the first connection element 104 to the container 1, or—vice versa—to allow to remove said first part 105E of the bag (FIG. 8) from the container 1 once it has been emptied of the substance to be dispensed and once the first connection element 104 has been disconnected from the container 1, wherein both when inserting said first part 105E of the bag into the container 1 and when removing said first part 105E of the bag 105 from the container 1, they remain stably constrained to said first connection element 104, at least said bag 105, said ring nut element 107 and said pump 106.

Preferably, the means 3 for connecting the first connection element 104 to said container removably and at said opening 1A comprise: a second connection element 9, having first connection members 9A (FIG. 3B) suitable to cooperate with counter connection members 10 (FIG. 3B) provided for at the access opening 1A of the container 1, suitable to mutually stably connect this second connection element to the upper edge of the container 1, and second connection members 9K (FIG. 2A) suitable to cooperate with counter connection members 108L (FIG. 4A) of the body 108 of the first connection element 104, to removably connect the latter to the second connection element 9 and lastly to the container 1.

In greater detail, the second connection element 9 preferably provides for an annular body 9C (FIG. 3B) having an outermost wall 9D which comprises the first connection members 9A which comprise—for example at the inner face of the outer wall 9D—a step 9E suitable to snap-cooperate with a corresponding step 1E provided for in the outer face of the upper edge of the container 1 (FIG. 3B).

The steps 9E and 1E are conformed so that by pushing the second connection element 9 coaxially and downwards along the neck of the container 1, the two steps are coupled to each other stably constraining these two components and preventing mutual axial movements.

Inside, the body 9C has a wall 9F suitable to abut against the upper face 1F of the edge of the container when the steps 9E and 1E are coupled to each other (FIG. 3B).

The second connection members 9K are for example provided for at the upper face 91 of the body 9C and they are for example suitable to cooperate with counter connection members 108L (FIG. 4A) of the first connection element 104 to obtain, for example, a removable connection of the bayonet-like type. To this end, for example, the counter connection members 108L have two circle arc protrusions, suitable to penetrate into corresponding openings 9G (FIG. 2A, B) provided for in the upper face 91 of the body 9C of the second connection element, and to rotate in tracks 9H provided for below said upper face 91 for removably mutually connecting the first and second connection element.

Advantageously, the counter connection members 108L have an end portion 108L' (FIG. 4B) suitable to penetrate (for example with a slight interference) into an end-of-stroke seat 9H' (FIG. 2B), so that there is an at least partial locking of the coupling of these two parts, and on the other hand, when the first connection element 104 is manually associated with the second connection element 9 (like in the case, for example, where a refill device is associated with a container, as described hereinafter) there is perceived an end-of-stroke.

Preferably, the container 1 has a neck 1K (FIG. 3B) whose outer face has a step 1E for the stable connection with the second connection element 9.

As discussed hereinafter, the assembly formed by the container 1 and by the second connection element 9 may be reused once the substance contained in the bag 105 has been fully dispensed, and this allows an advantage in terms of environmental sustainability of the device.

The volume of the container is greater than that of the full bag.

The bag 105 is preferably made of thermoplastic material, for example: PP, PE, LDPE, HDPE, but there may be provided for a bag made of another deformable material suitable to contain a fluid substance, such as for example aluminium plastic-coated paper or a material consisting of multilayer material for example PP+PA, PP+EVOH, PE+PA, PE+EVOH, of the conventional type for the person skilled in the art in any case.

As already indicated further above, the first connection element 104 comprises a tubular body 108 having an upper part 108H (FIG. 4A) and a lower part 108K which delimit a tubular through seat 108C (FIG. 4C) suitable to at least partially, and preferably fully, house the neck 105A of the bag 105 and at least partially the pump 106. When associated with the second connection element 9, the tubular body is preferably coaxial to the longitudinal axis X1 of the container of the bag of the second connection element.

The connection means 108F (FIG. 4A) suitable to cooperate with counter connection means 107C, (FIG. 5) provided for in the ring nut element 107, axially stably constrain the first connection element 104 and the ring nut element 107 to each other, and comprise, for example at the outer face of the tubular wall of the upper part 108H of the body 108, a step 108J (FIG. 4C) suitable to snap-cooperate with a corresponding step 107J (FIGS. 5 and 10A) of the ring nut element 107, provided for in the inner face 107B (FIG. 10A) of the tubular body 107A of the ring nut and at a lower opening 107F of such body 107A (FIG. 3B). The steps 108J and 107J are conformed so that—by pushing the ring nut coaxially and downwards along the first connection element 104—the steps are coupled to each other stably constraining these two components and preventing mutual axial movements (as shown in FIG. 6A).

The connection means 108G (FIG. 4A) suitable to cooperate with counter connection means 107B (FIG. 5) provided for in the ring nut element 107, rotatably connect the first connection element 104 and the ring nut element 107 to each other, preventing mutual rotations, and comprise, for example, at the outer face of the tubular wall of the upper part 108H of the body 108, a gear tooth 108Q (FIG. 4A) suitable to cooperate with a is corresponding counter gear tooth 107L (FIGS. 5 and 10A) of the ring nut element 107, provided for in the inner face 107B (FIG. 11A) of the tubular body 107A of the ring nut. The gear teeth 108Q and 107L are conformed so that—by pushing the ring nut coaxially and downwards along the first connection element 104 the two gear teeth mesh with each other stably constraining these two components and preventing the mutual rotations.

The lower part 108K (FIG. 4A) of the tubular body 108 of the first connection element 104 forms an annular appendage 108W (FIG. 4A) which forms a sort of protruding step with respect to the upper part 108H of the body 108. As mentioned above, the two circle arc protrusions 108L for removably connecting the first connection element 104 with the second connection element 9 depart from this appendage, angularly spaced apart from each other. The lower part 108K—at the lower end thereof—has an intermediate annular fissure 108S, an outermost annular flat surface 108R, provided for between the fissure and the annular appendages 108L, and a lower tubular wall 108T.

The annular flat surface 108R is suitable to abut against the flange 9E (FIG. 3B) of the second connection element 9 when the latter is connected to the container 1. Furthermore, as described hereinafter, this surface is also suitable to facilitate the automated filling of the bags, given that it can abut against a rest surface 115 (FIG. 9C) of a station for filling the bags when the latter are associated with the first connection element 104 alone (a portion of this rest surface is schematically shown in FIG. 4E and in FIG. 9C).

The intermediate annular fissure 108S, forms a seat for inserting an upper edge of a protection element 116 (FIG. 9A) having a thickness S1 substantially equal to the transversal dimensions D8 (FIG. 4D) of the fissure 108S of the first connection element 104 so as to forcedly insert this upper edge of the second container 116 thereinto.

The inner tubular wall 108T is suitable to stabilise the position of the bag 105 both when the latter is associated with the first connection element 104 and guarantee the coaxiality thereof with the element 104, and when the bag 105 simply rests on the element 1044 and it is not yet stably constrained to this element 104 by the ring nut 107. To this end, preferably the tubular wall 108T is dimensioned so that the end portion thereof is in is contact with and surrounds at least one upper section T1 (FIG. 4C) of the first part 105E of the bag provided for immediately below the part 105F of the bag for connecting with the neck 105A.

The tubular wall 108T also defines the maximum transversal overall dimensions that the bag 105 may have when it is fully filled with the substance to be dispensed. As shown in FIG. 4C, the inner diameter D12 of the tubular wall 108T must be greater than or equal to the maximum transversal diameter D7 of the bag 105 when it is fully filled with the substance to be dispensed, and this inner diameter D12 is smaller than or equal to the minimum diameter D1 of the opening of the container 1.

Along the outer face thereof, the inner tubular wall 108T has a plurality of vertical reliefs 108U (FIG. 4A) which are suitable to allow the external air to flow into the space S5 (FIG. 1) which is created between the outer face of the bag 105 and the inner face of the container 1. This air circulation is necessary should there be used an airless pump, given that it allows the bag 105 to collapse as the substance contained therein is dispensed.

The reliefs 108U also allow the outflow of air of the air from the container when a bag 105 is inserted into the container (as described hereinafter).

The connection element also has through holes 8V (FIG. 4B) in the flange 108E, also designed to increase the circulation of air from inside the container towards the external when inserting a bag and also allow the collapsing of the bag should the pump be of the airless type.

A further air exchange occurs also because there is no hermetic connection between the ring nut 107 and the first connection element 104, considering that the steps 107J of the ring nut 107 do not extend over the entire circumference of the outer wall of the ring nut, but only for circle arcs of this circumference.

As already indicated further above, the ring nut element 107 has means 107D suitable to stably connect the pump 106 to the ring nut, the latter means for example comprise an annular flange 107M (FIG. 10B) which departs from the inner surface of the tubular wall 107E of the ring nut element 107, the innermost vacant edge 107N of this annular flange 107M is suitable to be snap-inserted into an annular fissure 106B provided for on the outer face of the body 106A of the pump 106 (FIG. 5), stably connecting the pump to the ring nut. The annular fissure 106B of the body of the pump 106 is delimited at the lower part by an annular flange 106C (FIG. 6B) having a lower annular flat surface 106D (5) suitable to abut against and stably lock the flange 105D of the neck 105A of the bag 105 to the first connection element 104, when the pump is stably connected to the ring nut element 107 and the latter is stably connected to the first connection element 104, so that the assembly comprising the pump 106, the ring nut element 107, the bag and the first connection element 104 is an assembly of components stably connected to each other. This assembly can then be removably connected to the container by connecting the first connection element 104 with the second connection element 9, as shown above (and as shown in FIG. 6).

The ring nut 107 at the annular flange 107M also provides for vertical abutments 107K (FIG. 10A) suitable to support and further improve the connection of the pump to the ring nut.

The pump 106 is of the conventional type for the person skilled in the art and therefore will not be described in detail hereinafter.

Preferably, the pump is of the airless type and it is for example suitable to create a maximum vacuum (with respect to the ambient pressure) comprised between about 400 and 800 millibars, and more preferably equal to about 600 millibars in the bag 105. The bag 105 in this range of maximum pressure values is fully deformed or collapsed and the fluid substance contained therein has been dispensed. Therefore, in the present context, the expression deformable bag is used to indicate a bag whose walls have collapsed fully at the pressure values created by the pump.

In the case of an airless pump, it is preferable to provide for a sealing member 120 (FIG. 6B) between the annular flange 106C of the pump and the flange 105D of the neck 105A of the bag 105, which ensures an airtight connection between the pump and the bag.

The device also comprises, connected to an upper stem 106F (FIG. 6A) of the pump 106, a common member 110 for dispensing and actuating the pump, and connected to a lower stem 106G a floater 111 (FIG. 1). Both the member 110 and the floater 111 are of the conventional type for the person skilled in the art and they will not be described in detail hereinafter.

The device also comprises a conventional cap 112 suitable to cover the parts of the device provided for above the second connection element 9 which remain exposed. Preferably, the inner tubular surface 112A (FIG. 6A) of the cap is in contact with the outer surface 107H (FIG. 11A) of the ring nut 107 and it abuts—at the lower part—against a lower shoulder 1071 of the ring nut and against a flat upper surface 9G (FIG. 2A) of the second connection element 9 (as shown in FIG. 6A).

The fluid substance to be dispensed may be of any type but preferably a cream, gel, foundation, serum etc.

In the context of the invention, the expression stable constraint is used to indicate a constraint such that once constrained to each other, the elements are not dissociated from other, when they are subjected to the common forces with which the device is handled in the various steps of use and/or loading and/removal thereof (shown in detail hereinafter). For example, the ring nut 107 and the first connection element 104 are not released from each other when said first connection element 104 is dissociated and moved away from the second connection element 9 and therefore from the container, and also the bag 105 is not released from the ring nut 107 and from the first connection element 104. So that by moving away said ring nut element 107 from the container 1, the bag 105 is also automatically removed from the container. Obviously, although the bag can be disassociated from the ring nut element and from the first connection element, such operation requires applying a significantly great suitable force, much greater than the one usually acting on the bag during the operations mentioned above, to the bag. Similar observations shall also apply to the stable connection of the pump 106 to the ring nut 107, for stably connecting the ring nut 107 to the first connection element 104, and for stably connecting the second connection element 9 to the neck 1K of the container 1.

Preferably, all components of the device are coaxial to a longitudinal axis X1 of the device and this facilitates the assembly of the various components of the device.

Furthermore, preferably, still with the aim of facilitating the assembly, all components of the device, and in particular, the first and the second connection element, the ring nut, and the pump, are symmetrical-shaped with respect to a common central symmetry axis X1, and more preferably they have a circular cross-section.

According to the invention, associated with the container 1 and with the second connection element 9 is a refill device 100 (FIG. 7) comprising a bag 105 already filled with a predefined amount of a substance to be dispensed, and a first connection element 104, a ring nut 107, a pump 106 and a member 110 for actuating the pump and dispensing the substance.

The refill device 100 is associated with the container 1, by inserting the part 105E of the bag 105, in the cavity 2 of the container 1 until the first connection element 104 abuts against the second connection element 9, and these two elements are connected to each other through respective removable connection means 9A 108D (of the bayonet-like type in the shown example).

In order to facilitate the insertion of the bag 105 filled with the substance to be dispensed, into the seat 2 of the container 1, the volume of this seat is preferably greater than the volume of the part 105E of the bag which is to be inserted into the seat. In the final bag insertion step, the air present in the seat 2 of the container may further flow out, thanks to the fact that the connection between the ring nut 107 and the first connection element 104 is not of the sealed type, and through the through holes 108V and the interspaces created by the reliefs 108U, provided for in the first connection element 104.

Once the refill device has been inserted into the container 1, there is obtained a device for containing and dispensing fluids identical to the devices in which the bag is filled when it is inserted into the container and not yet stably constrained to the pump by the ring nut element.

Once the fluid substance has been fully dispensed, the bag 105, together with the first connection element 104, the ring nut 107 and the pump 106 can be easily removed from the container 1 (as shown in FIG. 8). For example, to this end the first connection element 104 is slightly rotated so as to open the connection means 9A 108D (of the bayonet-like type in the shown example) and be able to disassociate it from the second connection element 9, by pulling the assembly upwards, stably connected to each other comprising, the emptied bag 105, the first connection element 104, the ring nut 107, the pump 106 and the dispensing and actuation member 110. Once the empty bag and the relative components associated therewith have been removed, the container 1 may be used once again, by associating a new refill device 100 therewith. In this manner, the container can be reused an indefinite number of times, this entailing a definite advantage from an environmental and ecological sustainability point of view.

As shown in FIG. 9A, the refill device 100 comprises a protection element 116 suitable to protect the part 105V (FIG. 9A) of the bag 105 filled with the substance to be dispensed and which protrudes at the lower part from the first connection element 104. To this end, the element 116 has a height equal to or slightly greater than H5 of this protruding type.

Preferably, in order to facilitate the insertion of the bag 105 into the protection element 106 the latter is open at the lower part, and it is therefore tubular shaped.

Preferably, for recycling purposes, the protection element is made of a paper material, for example comprising at least one paper layer, or it is made of metal for example a tin strip or it is made of plastic material for example recyclable, for example PET-PP-PE. Preferably, the protection element has a thickness S1 comprised between 0.2 mm and 2 mm, more preferably equal to about 1 mm.

As discussed above, the protection element 116 is removably connected to the first connection element 104. To this end, preferably the intermediate annular fissure 108S (FIG. 9C), forms a seat for inserting an upper edge of a protection element 116 (FIG. 9 B) having a thickness S1 substantially equal to the transversal dimensions D8 (FIG. 4D) of the fissure 108S of the first connection element 104 so as to forcedly insert this upper edge of the second container 116 thereinto. In this situation, in order to improve the stability of the protection element 116, the part 108T of the first connection element is in contact with the inner face of an upper section of the protection element 116 (as shown in FIG. 9B).

Furthermore, preferably, the maximum transversal dimension D101 (FIG. 9A) of the protection element 116 is smaller than the maximum transversal dimension D108 (FIG. 4A) of the lower part 108K of the connection element 104, so as to facilitate the operations for filling the bag, given that a lower outer edge 108R of the connection element 104 (FIG. 9C, 9B) remains outside the protection element.

To use the refill device, one has to remove the protection element 116 and therefore insert the refill device into the container 1, as discussed above.

Therefore, the protection element 116 has the sole purpose of protecting the bag 105 (generally made of a material with limited thickness, therefore relatively fragile) during storage and transportation of the refill device, and preferably also during the loading of the bag.

The bag 105 is loaded by associating an empty bag 105 with the first connection element 104 as described above, and the first connection element and the bag are therefore associated with a filling station 115 (partially represented in FIG. 9C)

Therefore, the bag is filled by associating the pump and the ring nut with the bag and with the first connection element, as described above.

Lastly, it should be observed that the embodiments described until now, have been provided by way of non-limiting example and that numerous variants all falling within the same inventive concept may be provided for, same case for example applying to the stable and/or removable connection means described until now which could be different from those shown until now, in any case conventional for the person skilled in the art.

The invention claimed is:

1. A fluid substances refill device (100), for a container (1) having an opening (1A) for access to a cavity (2) of the container, said refill device comprising:

a first connection element (104) comprising:

first connection means (108D) for connecting said refill device to said container removably and at said opening (1A), a bag (105) made of deformable material, filled with a predefined amount of said fluid substances, and comprising:

at least one first part (105E), filled with said substance to be dispensed and suitable to be housed inside said cavity (2) of the container and in turn delimiting a cavity (105C) suitable to contain said fluid substances, a neck (105A) which departs from an end of said first part (105E) of the bag (105), and which has an opening (105B) for access to said cavity 105C of said first part (105E) of the bag, a connection part (105F) between said neck and said first part (105E), —and a flange (105D) which extends transversely to said neck of the bag at said opening (105B) of the neck;

a pump (106) which can be actuated manually to draw the fluid substance from the bag (105) and supply it externally to the bag, wherein the pump (106) is at least partially housed in the neck (105A) of the bag (105);

a ring nut element (107) connected to said first connection element (104), and suitable to connect said pump (106) and said bag (105) to said first connection element (104);

wherein the first connection element (104) comprises:

a body (108) having an upper part (108H) and a lower part (108K) which delimit a tubular through seat (108C) suitable to at least partially house the neck (105A) of the bag (105) and at least partially the pump (106), when it is inserted into the neck;

wherein said upper part (108H) comprises: an upper opening (108A) delimited by a wall (108E) for resting at least one portion of said flange (105D) of the neck (105A) of the bag (105) and connection means (108F) (108G) suitable to cooperate with counter connection means (107B), (107C) provided for in the ring nut element (107) for stably constraining said first connection element (104) and said ring nut element (107) to each other, so that said ring nut element (107)—when it is connected to the first connection element (104) and to the pump (106)—constrains also said first connection element (104) and said at least one portion of said flange (105D) to each other; and so that when said first connection element (104) is released from the container (1), the bag remains stably associated with the refill device and with an assembly formed by the first connection element (104), by the ring nut element (107), and by the pump (106);

wherein the lower part (108K) of the first connection element (104), comprises a lower opening (108B) and said first connection means (108D) for connecting—removably and at said opening (1A)—said refill device to said container, said first connection means (108D) being suitable to cooperate with counter connection means (3) provided for at the access opening (1A) of the container (1) to removably connect said body (108) of the first connection element (104) to said container;

and wherein said lower part (108K) of the first connection element (104), comprises second connection means (108S) for removably connecting a protection element (116), suitable to protect the bag (105) containing the fluid substance, to said first connection element (104) before said refill device is associated with the container.

2. The refill device (100) according to claim 1, characterised in that the protection element (116) is a tubular element, open at the lower part and sized so as to fully cover the side wall of the bag (116) when said protection element (116) is associated with the first connection element (1).

3. The refill device (100) according to claim 1 characterised in that the lower part (108K) of the tubular body (108) of the first connection element (104) comprises an annular appendage (108W) protruding with respect to the upper part (108H) of the body (108), and that both the first (108D) and the second (108S) connection means are provided for on said annular appendage (108W).

4. The refill device (100) according to claim 1, characterised in that the first connection means (108D) are provided for at a distance (D100) from a longitudinal axis (X1) of said first connection element, greater than the distance (D101) of the second connection elements from said longitudinal axis (X1).

5. The refill device (100) according to claim 1, characterised in that the lower part (108K) of the first connection element (104), terminates at the lower part with a tubular wall (108T) sized so as to come into contact with at least one portion (T1) of the bag 101 when the latter is connected to the first connection element, so as to stabilise the position of the bag (105), wherein, said portion (T1) of the bag comprises a part of the bag immediately below the part (105F) of the bag for connection with the neck (105A).

6. The refill device (100) according to claim 5 characterised in that the first (108D) and second connection elements are provided for above the tubular wall (108T).

7. The refill device (100) according to claim 1, characterised in that the second connection elements comprise an annular fissure suitable to delimit a seat for inserting an upper edge (116A) of the element (116) having a thickness (S1) substantially identical to the transversal dimensions (D8) of said fissure (108S) so as to forcedly insert this upper edge of the second container (116) thereinto.

8. The refill device (100) according to claim 1, characterised in that the lower part (108K) has—externally to the second connection means (108S) for the protection element (116)—an annular flat surface (108R) suitable both to facilitate the connection with the container (1) and the bag filling operations, and that the first connection means (108D) are provided for externally with respect to said annular flat surface (108R).

9. The refill device (100) according to claim 1, characterised in that the first connection means (108D) comprise at least one protruding element (108L), provided for outermost with respect to the surface of said body (108) and of said second element (108K), for removably connecting the first connection element (104) with counter means (9G) so as to obtain a shape coupling of the bayonet type, wherein said counter means (9G) are provided for in a second connection element (9) stably associated with the container (1) at the opening (1A) thereof.

10. The refill device (100) according to claim 1, characterised in that the first connection element (104) comprises first connection means (108F) of the first connection element (104) suitable to cooperate with counter connection means (107C), provided for in the ring nut element (107), for axially stably constraining the first connection element (104) and the ring nut element (107) to each other, and they comprise, at the outer face of the tubular wall of the upper part (108H) of the body (108), a step (108J) suitable to snap-cooperate with a corresponding step (107J) of the ring nut element (107), provided for in the inner face (107B) of the tubular body (107A) of the ring nut and at a lower opening (107F) of such body (107A), wherein said steps (108J) and (107J) are conformed so that—by pushing the ring nut coaxially and downwards along the first connection element (104)—the two steps are coupled to each other stably constraining these two components and preventing mutual axial movements; and second connection means (108G) of the first connection element suitable to snap-cooperate with counter connection means (107B) provided for in the ring nut element (107), suitable to connect the first connection element (104) and the ring nut element (107) to each other, preventing mutual rotations, and they comprise, at the outer face of the tubular wall of the upper part (108H) of the body (108), a gear tooth (108G) suitable to cooperate with a corresponding counter gear tooth (107L) of the ring nut element (107), provided for in the inner face (107B) of the tubular body (107A) of the ring nut, said gear teeth (108Q) and (107L) being conformed so that—by pushing the ring nut element coaxially and downwards along the first connection element (104)—the two gear teeth mesh with each other stably constraining these two components and preventing mutual rotations.

11. A fluid substances refill device (100), for a container (1) having an opening (1A) for access to a cavity (2) of the container, said refill device comprising:

a first connection element (104) comprising:

a first connector (108D) for connecting said refill device to said container removably and at said opening (1A), a bag (105) made of deformable material, filled with a predefined amount of said fluid substances, and comprising:

at least one first part (105E), filled with said substance to be dispensed and suitable to be housed inside said cavity (2) of the container and in turn delimiting a cavity (105C) suitable to contain said fluid substances, a neck (105A) which departs from an end of said first part (105E) of the bag (105), and which has an opening (105B) for access to said cavity 105C of said first part (105E) of the bag, a connection part (105F) between said neck and said first part (105E), —and a flange (105D) which extends transversely to said neck of the bag at said opening (105B) of the neck;

a pump (106) which can be actuated manually to draw the fluid substance from the bag (105) and supply it externally to the bag, wherein the pump (106) is at least partially housed in the neck (105A) of the bag (105);

a ring nut (107) connected to said first connection element (104), and suitable to connect said pump (106) and said bag (105) to said first connection element (104);

wherein the first connection element (104) comprises:

a body (108) having an upper part (108H) and a lower part (108K) which delimit a tubular through seat (108C) suitable to at least partially house the neck (105A) of the bag (105) and at least partially the pump (106), when it is inserted into the neck;

wherein said upper part (108H) comprises: an upper opening (108A) delimited by a wall (108E) for resting at least one portion of said flange (105D) of the neck (105A) of the bag (105) and a first connector (108F) (108G) suitable to cooperate with a first counter connector (107B), (107C) provided for in the ring nut (107) for stably constraining said first connection element (104) and said ring nut (107) to each other, so that said ring nut (107)—when it is connected to the first connection element (104) and to the pump (106)—constrains also said first connection element (104) and said at least one portion of said flange (105D) to each other; and so that when said first connection element (104) is released from the container (1), the bag remains stably associated with the refill device and with an assembly formed by the first connection element (104), by the ring nut element (107), and by the pump (106);

wherein the lower part (108K) of the first connection element (104), comprises a lower opening (108B) and said first connector (108D) for connecting—removably and at said opening (1A)—said refill device to said container, said first connector (108D) being suitable to cooperate with a second counter connector (3) provided for at the access opening (1A) of the container (1) to removably connect said body (108) of the first connection element (104) to said container;

and wherein said lower part (108K) of the first connection element (104), comprises a second connector (108S) for removably connecting protector (116), suitable to protect the bag (105) containing the fluid substance, to said first connection element (104) before said refill device is associated with the container.

* * * * *